US006572105B2

(12) United States Patent
Baker et al.

(10) Patent No.: US 6,572,105 B2
(45) Date of Patent: Jun. 3, 2003

(54) DUAL OVERLAPPING GATES TO CONTROL MEDIA MOVEMENT THROUGH AN IMAGE FORMING APPARATUS

(75) Inventors: Christopher Lee Baker, Salvisa, KY (US); Bryan Michael Blair, Lexington, KY (US); Daniel Lee Carter, Georgetown, KY (US); Billy Carl Chappel, Mt. Sterling, KY (US)

(73) Assignee: Lexmark International, Inc., Lexington, KY (US)

( * ) Notice: Subject to any disclaimer, the term of this patent is extended or adjusted under 35 U.S.C. 154(b) by 49 days.

(21) Appl. No.: 09/965,268

(22) Filed: Sep. 27, 2001

(65) Prior Publication Data

US 2003/0057642 A1 Mar. 27, 2003

(51) Int. Cl.[7] ..... B65H 29/60
(52) U.S. Cl. ..... 271/303; 271/302; 271/305
(58) Field of Search ..... 271/301, 302, 271/303, 304, 305

(56) References Cited

U.S. PATENT DOCUMENTS

| | | | | | |
|---|---|---|---|---|---|
| 3,997,263 | A | | 12/1976 | Stemmle | |
| 3,997,265 | A | | 12/1976 | Menon et al. | |
| 4,251,000 | A | | 2/1981 | Templeton | |
| 4,277,061 | A | | 7/1981 | Nagel et al. | |
| 4,373,710 | A | | 2/1983 | Hansen et al. | |
| 4,441,704 | A | * | 4/1984 | Uchida et al. | 271/303 |
| 4,486,015 | A | * | 12/1984 | Takahashi | 271/305 |
| 4,618,134 | A | | 10/1986 | Kawaguchi et al. | |
| 4,691,914 | A | | 9/1987 | Lawrence | |
| 4,693,586 | A | | 9/1987 | Sumida et al. | |
| 4,711,550 | A | | 12/1987 | Sumida et al. | |
| 4,785,942 | A | * | 11/1988 | Van Leijenhorst et al. | 209/657 |
| 4,979,727 | A | | 12/1990 | Koike et al. | |
| 5,156,386 | A | | 10/1992 | Kitajima et al. | |
| 5,226,547 | A | * | 7/1993 | Malatesta | 209/657 |
| 5,505,442 | A | | 4/1996 | Chang et al. | |
| 5,553,528 | A | | 9/1996 | Zoltner | |
| 5,594,542 | A | | 1/1997 | Sugimoto et al. | |
| 5,794,931 | A | | 8/1998 | Heilman et al. | |
| 5,799,936 | A | | 9/1998 | Sekine et al. | |
| 6,045,127 | A | | 4/2000 | Fukui | |
| 6,142,469 | A | | 11/2000 | Nanba et al. | |
| 6,176,485 | B1 | * | 1/2001 | Wingate | 271/303 |
| 6,185,380 | B1 | | 2/2001 | Abe et al. | |
| 6,196,464 | B1 | | 3/2001 | Patterson et al. | |
| 6,234,475 | B1 | * | 5/2001 | Weigel et al. | 271/303 |

* cited by examiner

*Primary Examiner*—Patrick H. Mackey
(74) *Attorney, Agent, or Firm*—John A. Brady

(57) ABSTRACT

A diverter to direct media within an image forming apparatus along one of three media paths. A first gate and a second gate are positioned in an overlapping arrangement and each is movable between up and down positions. Each of the gates includes a biasing member to bias the gates towards the down position. An actuator contacts the second gate to move it to the up position. The overlapping arrangement of the first and second gates causes the first gate to also be moved to the up position when the second gate moves to the up position. A second actuator contacts the first gate to move the gate from the down position to the up position independently of the second gate.

18 Claims, 6 Drawing Sheets

DUAL OVERLAPPING GATES TO CONTROL MEDIA MOVEMENT THROUGH AN IMAGE FORMING APPARATUS

BACKGROUND OF THE INVENTION

Image forming apparatus such as printers, facsimile machines, copy machines, and the like, often include a number of different media paths for processing media. Different media paths are required for duplex printing, finishing operations such as collating, stapling, etc., and simply directing the media out of the image forming apparatus. Diverters are positioned at the intersections to accomplish paper direction to the appropriate media paths.

Diverters may take a variety of forms to direct the media, and in one common embodiment include a movable gate that can move between first and second positions. In the first position, media is diverted to a first media path and in the second position the media is diverted to a second media path. Single gates are effective when diverting media between one of two paths. However, a problem occurs when attempting to divert media to more than two paths.

One solution includes placing two separate diverters in series alignment along the media path with one gate directly behind the other. The first diverter directs the media to either a first or second path, and the second diverter further directs the paper to continue along the second path, or to a third path. A drawback of this design is the additional amount of space necessary for positioning the two diverters. Often times media paths do not have the required amount of space, especially considering the increasing demand for reduced overall sizes of image forming apparatus.

Another drawback of previous diverters is the time necessary for moving the gate or gates between media paths. This movement reduces throughput of the image forming apparatus. Movement of the gates between the various media paths should not negatively impact the maximum throughput of the image forming apparatus. Additionally, the diverter should not be a cause of media jams within the image forming apparatus.

SUMMARY OF THE INVENTION

The present invention is directed to a diverter comprising a pair of gates aligned in an overlapping arrangement. Each of the gates may be movable between up and down positions, and each gate may be biased towards one of the positions. A first actuator may be movably positioned to contact one of the gates and move it from the down position to the up position. A second actuator may operatively contact the second gate to move it from the down position to the up position. A first media path may be formed by both gates being in the down position caused by the force of the biasing members. A second media path may be formed by the first actuator contacting the first gate and moving it to the up position. Because of the overlapping arrangement, movement of the first gate may cause the second gate to also move to the up position. Therefore, the actuator may effectively move both gates from the down to the up position. A third media path may be formed when the first gate is in the down position by the biasing member while the second actuator may act on the second gate to move it to the up position.

DETAILED DESCRIPTION OF THE INVENTION

Figure 1:
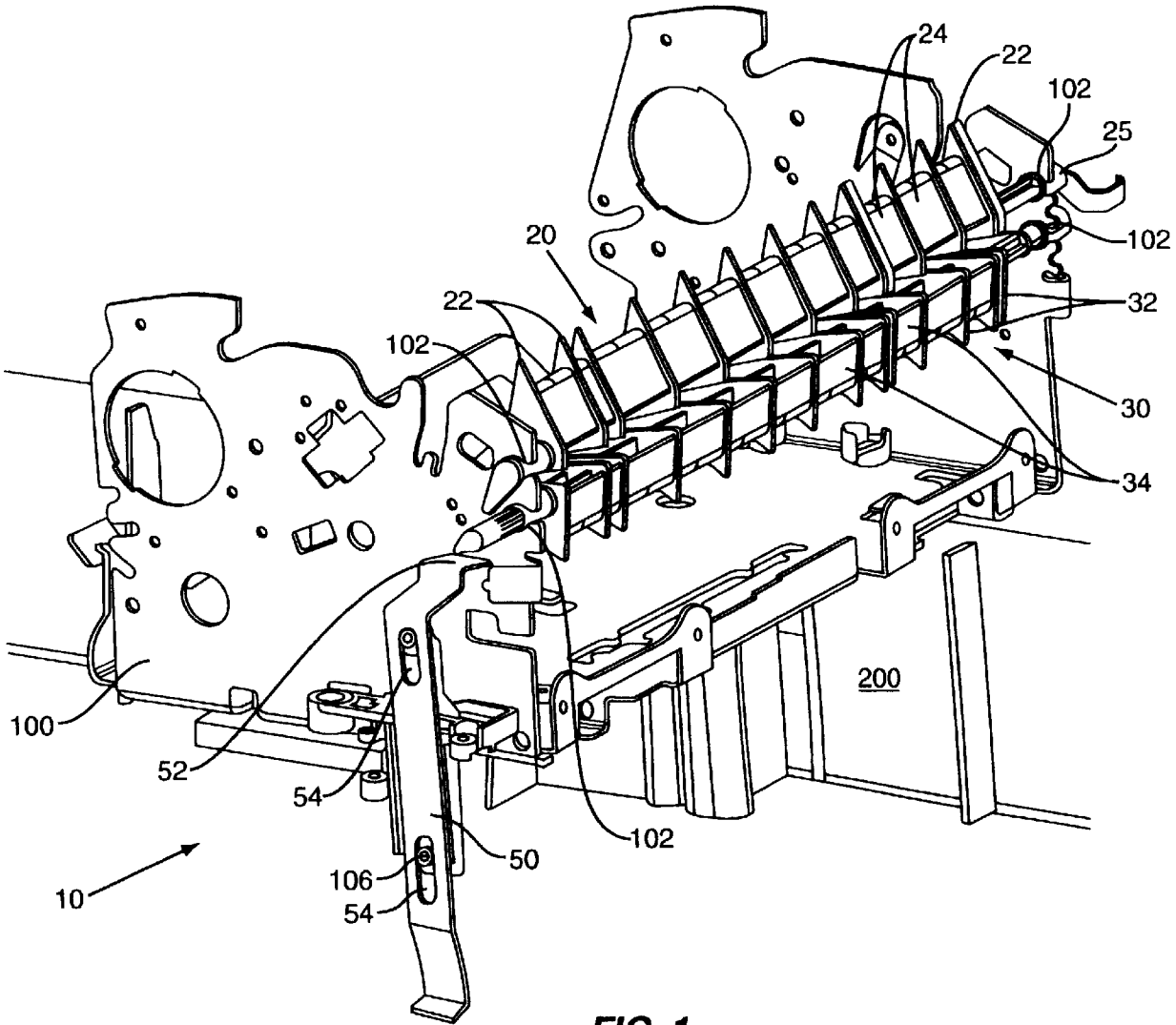
FIG. 1 is a perspective view of the overlapping gate arrangement of the diverter according to one embodiment of the present invention.

A diverter 10 within an image forming apparatus to direct media along a plurality of media paths is illustrated in FIG. 1. A first gate 20 and a second gate 30 are positioned in an overlapping arrangement and each is movable between up and down positions. Each gate 20, 30 includes a biasing member 40 (FIG. 6) to bias the gates towards the down position. An actuator 50 contacts the second gate 30 to move it to the up position. The overlapping arrangement of the first gate 20 and second gate 30 causes the first gate 20 to also be moved to the up position when the second gate 30 is moved to the up position. A second actuator 60 (FIG. 6) contacts the first gate 20 to move the gate from the down position to the up position independently of the second gate 30.

Figure 2:
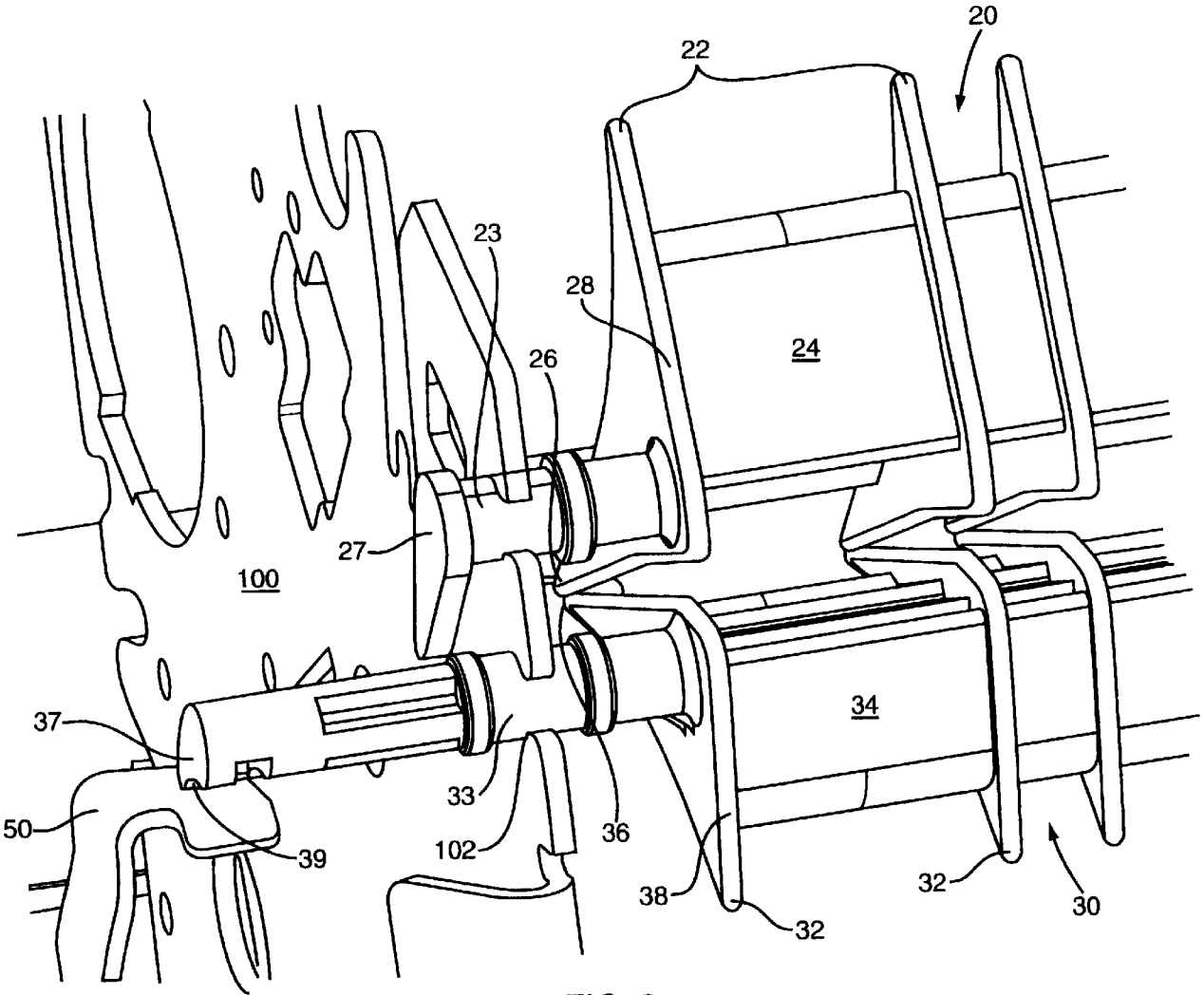
FIG. 2 illustrates a partial perspective view of the actuator contacting the cam of the second gate to position the first and second gates in the up position.

FIG. 1 illustrates the first gate 20 and second gate 30 positioned within a frame 100. The first gate 20 extends across the width of the media path and in the embodiment illustrated includes ribs 22 spaced apart by a body portion 24. The ribs 22 may be spaced across the length of the first gate 20 in a variety of orientations. In the embodiment illustrated in FIG. 1, ribs 22 are spaced across the length and also at the front and back end. As best illustrated in FIG. 2, the ribs 22 are substantially triangular shape having a leading edge 26 upstream of a back edge 28.

A shaft 23 extends from the first gate 20 and includes first and second ends that extend outward to mount within the frame 100. The shaft 23 may extend through the entire length of the first gate, or may extend outward from only the outer ribs 22. The frame 100 includes a pair of openings 102 sized to receive the ends of the shaft 23 and permit rotation. The openings 102 may be complete apertures, or may e partial apertures having a channel as illustrated best in FIG. 2 through which the shaft 23 may be inserted. A cam 27 extends outward from the shaft first end. This cam 27 is designed to preclude gate 20 from inadvertently coming out. A second can 25 may be positioned on the shaft second end in a similar manner.

The second gate 30 is similar to the first gate 20 and includes ribs 32 positioned along the length including the front and back ends. In one embodiment as illustrated in FIG. 2 the ribs of the second gate 30 are spaced at the same locations as the first gate 20 ribs 22 with a body portion 34 extending between the ribs 32. The second gate ribs 32 contact the corresponding first gate ribs 22 to prevent media from entering between the gates when both are either in the up or down positions. The spacing of the ribs 22, 32 is such that there are no gaps through which the media may inadvertently pass into the wrong media path. In one embodiment as illustrated in FIG. 2, ribs 32 are substantially triangular shape having a leading edge 36 upstream of a back edge 38.

Shaft 33 extends outward from the first and second ends of the second gate 30 and mounts within frame openings 102 similar to the first gate 20. A cam 37 extends from the shaft first end and includes a contact surface 39 that is contacted by the actuator 50 when moving the second gate 30 from the down to the up position. The cam 37 is shaped so the contact surface 39 maintains contact with the actuator 50 during the actuation process. In one embodiment, cam 37 includes a curved edge that maintains contact with the actuator 50 during rotation. One skilled in the art will understand that a variety of different cams 37 and contact surfaces 39 may be used for moving the second gate 30 from the down to the up position. The cam 37 is adhered to the shaft 33 such that movement of the cam 37 is transferred resulting in movement of the second gate 30. A second cam (not illustrated) may be positioned at the second end of the shaft 33 within the second gate 30.

Figure 6:
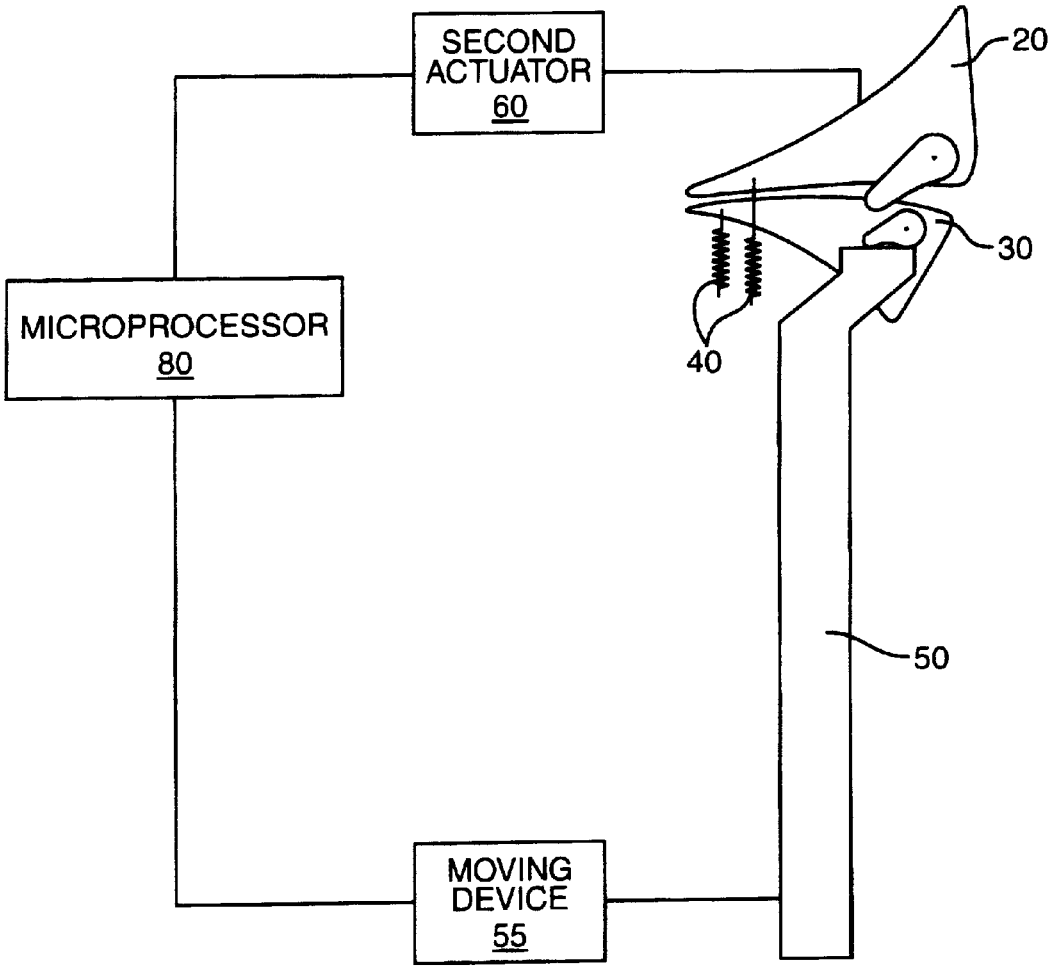
FIG. 6 is a schematic view illustrating the control structure for moving the first and second gates between the up and down positions.

One or more biasing members 40 are operatively connected to each of the gates to bias the gates towards the down position as illustrated schematically in FIG. 6. In one embodiment, the biasing members 40 are torsion springs that span between the gates 20, 30 and the frame 100. In this embodiment, a first end of the respective biasing members 40 is attached to the gates 20, 30, respectively, and a second end of each is attached to the frame 100. The second end may also be attached to a non-frame member provided it causes biasing force to move the gate toward the down position. The force of the biasing members 40 is such that the each of the gates 20, 30 will assume the down position when no other forces are acting on gates. The biasing members 40 prevent floating of the gates which may cause incorrect gate position which would direct the media to the wrong path. The biasing force, however, is not so great that it cannot be overcome by the actuator 50 or the second actuator 60 as will be described below. One or more biasing members 40 may be positioned on each gate 20, 30. Various other manners of biasing the gates 20, 30 in the down position are available and may be included within the present invention.

The actuator 50 functions to move the second gate 30 and thus the overlapping first gate 20 from the down position to the up position. As illustrated in FIG. 1, the actuator 50 includes a surface 52 that contacts the second gate cam 37. One or more apertures 54 may mate with frame extensions 106.

A moving means illustrated schematically as 55 in FIG. 6 provides motion to the actuator 50. The moving device 55 receives signals from a central microprocessor 80 that controls the movement of media through the diverter 10. The moving device 55 may include a variety of mechanical forms as is well understood in the art and is not detailed herein.

A second actuator 60 moves the first gate 20 from the down position to the up position independently of the first gate 20. In one embodiment, the second actuator 60 is a solenoid operatively contacting the first gate 20 and includes an arm that is attached to the cam 27 or shaft 23 and moves between extended and retracted positions to rotate the first gate 20. Microprocessor 80 controls the function of the second actuator 60 to control the movement of media through the diverter 10.

Figure 3:
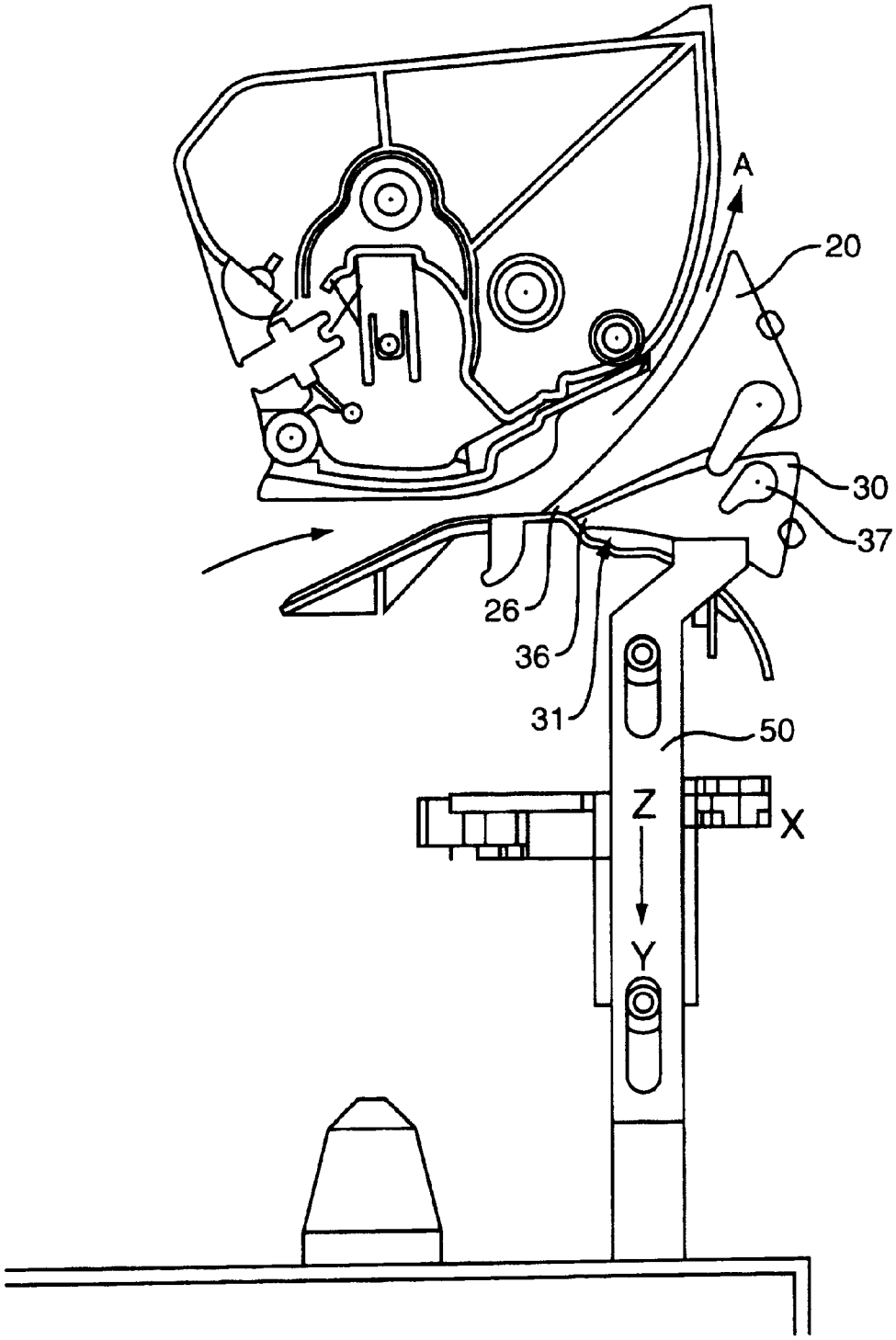
FIG. 3 is a side view illustrating the first and second gates each in down positions to direct the media to a first path.
Figure 4:
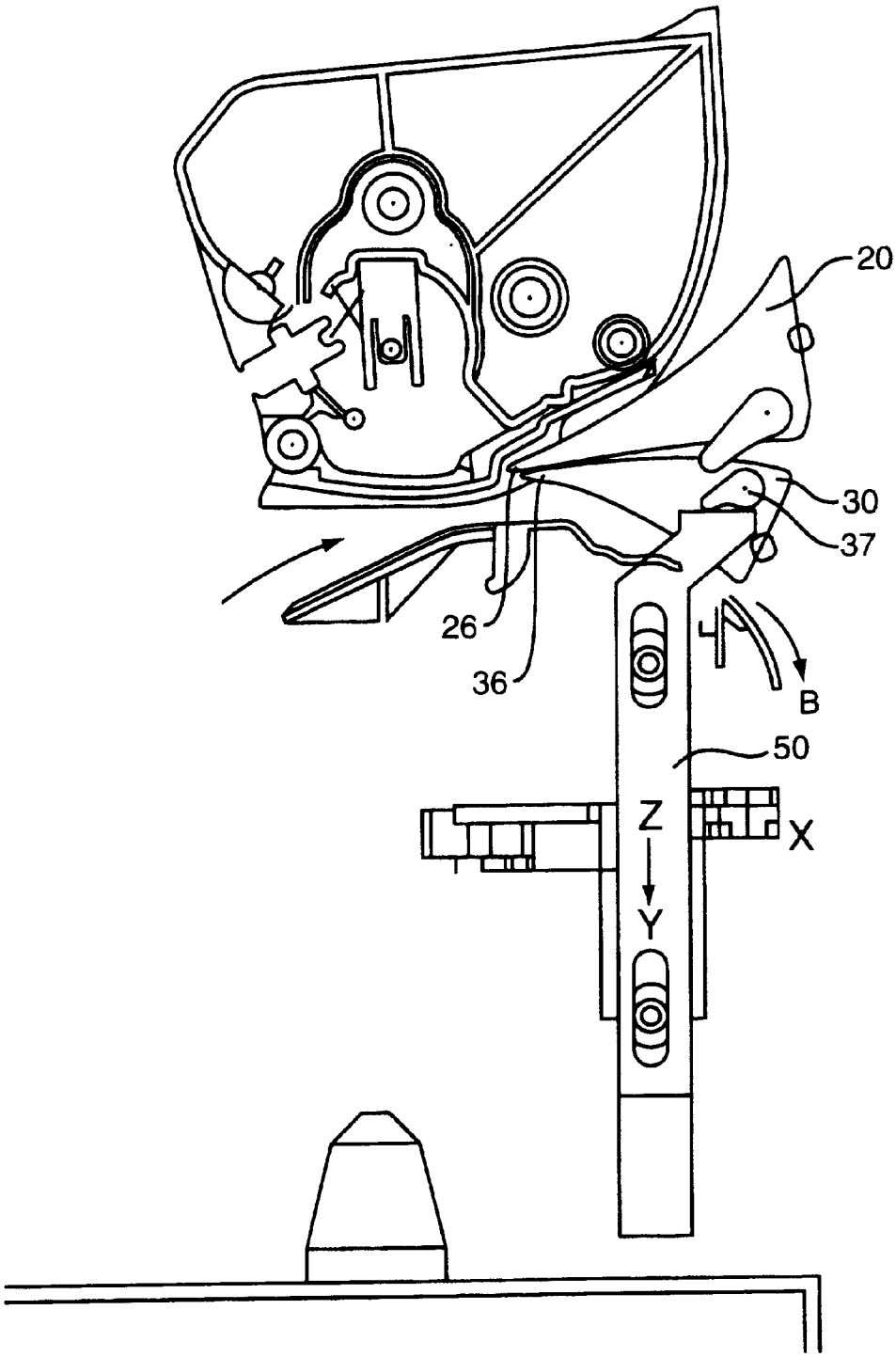
FIG. 4 is a side view illustrating the first and second gates each in up positions to direct the media to a second path.
Figure 5:
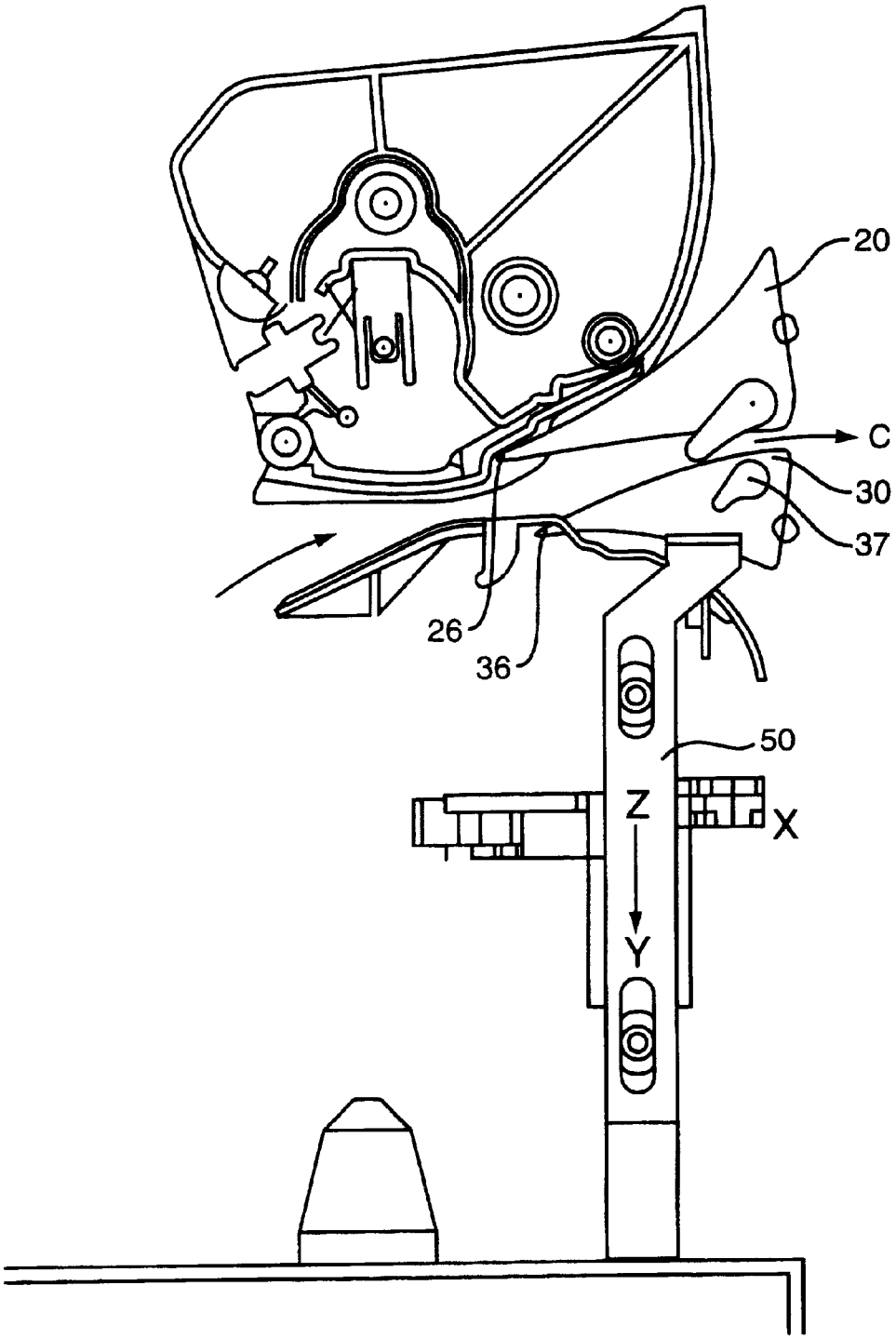
FIG. 5 is a side view illustrating the first gate in the up position and the second gate in the down position to direct the media to a third path.

FIGS. 3, 4, and 5 illustrate the movement of media sheets through first, second, and third media paths respectively. FIG. 3 illustrates the positioning of the gates to divert media sheets to the first paper path A. In this position, both the first gate 20 and second gate 30 are in the down position caused by the force exerted by the biasing members 40. The first gate lead edge 26 is angled downward above the second gate 30. The first gate 20 is shaped to accommodate the movement of the media sheets and prevent sticking or otherwise inhibiting the movement of the media. Note also the existence of void 31 delimited by the lower surface of gate 30 and a slide plate (not labeled). Void 31 allows paper to continue along media path B (FIG. 4) even though the position of gate 30 has been changed from an up position to a down position. This allows faster switching between paper paths and thus a higher throughput on the image forming apparatus.

FIG. 4 illustrates the first gate 20 and the second gate 30 in the up positions to divert the media sheets to the second media path B. The actuator 50 is moved to contact the cam 37 and overcome the force of the biasing member 40 to move the second gate 30 to the up position. The overlapping position of the first gate 20 relative to the second gate 30 causes contact between the gates thus also moving the first gate 20 to the up position. In one embodiment, the first gate ribs 22 contact the second gate ribs 32 when moving to the up position. The second gate 30 is shaped to allow the media sheet to move along the media path without becoming jammed. A void similar to void 31 may exist above the upper surface of gate 20. Again, this allows for paper to continue down media path A despite switching of the gates 20, 30 to open media path B.

FIG. 5 illustrates the diverter 10 being positioned to direct a media sheet to the third media path C. The second gate 30 is in the down position by the force of the biasing member 40. The second actuator 60 is activated to overcome the force of the biasing member 40 and move the first gate to the up position. The first gate 20 and second gate 30 are separated with the media path being formed by a combination of both gates.

The diverter 10 may be positioned at a number of locations within an image forming apparatus. In one embodiment, the diverter 10 is placed downstream of a fuser (not illustrated). Upon leaving the fuser, the media sheets may be diverted to a first media path A out of the apparatus, to a second media path B to a duplexer to form an image on the second side of the media sheet, or to a third media path C to a finisher.

The frame 100 supports the gates 20, 30 during the movement from the up and down positions. In one embodiment, the frame is a fuser frame mounted within the body of the image forming apparatus 200. In another embodiment, the gates 20, 30 are mounted within the image forming apparatus frame 200.

The terms "first", "second", "up", and "down" are not intended to limit the present invention, but are rather intended to identify and distinguish the gates 20, 30 and describe their relative positioning. The diverter 10 may perform in other manners such as the actuator contacting the first gate, and movement of the first gate causes movement of the second gate. Additionally, it should be understood that the gates may be biased in the up position and the first and second actuators overcome the force and move the gates towards the down position.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. An apparatus to direct media within an image forming apparatus comprising:

a. a first gate selectively movable between an up position and a down position;

b. a second gate being selectively movable between the up position and the down position, said second gate being adjacent to the first gate and contacting the first gate in the up position;

c. an actuator to move the second gate from the down position to the up position;

d. a second actuator operatively contacting the first gate to move the first gate from the down position to the up position independently of the second gate.

2. The apparatus of claim 1, further comprising a cam extending outward from an end of the second gate, the actuator including a contact surface that contacts the cam to move the second gate from the down position to the up position.

3. The apparatus of claim 2, wherein the cam extends from an axle of the second gate.

4. The apparatus of claim 1, further comprising a first biasing member attached to the first gate and a second biasing member attached to the second gate to bias the first gate and the second gate towards the down position.

5. An apparatus for directing media along a plurality of media paths within an image forming apparatus comprising:

a. a first gate and a second gate each being movable between first and second positions, the first gate and the second gate being aligned in an overlapping arrangement with the second gate being in the second position when the first gate is in the second position;

b. a first media path defined by the first gate being in the first position and the second gate being in the first position;

c. a second media path defined by the first gate being in the second position and the second gate being in the second position; and d. a third media path defined by the first gate being in the first position and the second gate being in the second position; and e. an actuator that moves the first gate from the first position to the second position and the overlapping arrangement causes contact between the first gate and the second gate to move the second gate from the first position to the second position.

6. The apparatus of claim 5, wherein each of the plurality of media paths requires one or fewer actuating devices acting on the first gate and the second gate.

7. The apparatus of claim 5, further including biasing members operatively connected to each of the first gate and the second gate to bias the first gate and the second gate towards the first position to form the first media path.

8. The apparatus of claim 5, further including an actuator that contacts the second gate to move the second gate to the up position and the first gate to the up position to form the second media path.

9. The apparatus of claim 8, further including a second actuator operatively contacting the first gate to move the first gate to the up position to form the third media path.

10. A diverter comprising:

a. first and second gates each being movable between first and second positions, the first gate being positioned adjacent to the second gate such that movement of the second gate from the first position to the second position results in the first gate moving to the second position;

b. biasing members attached to each of the pair of gates to bias each of the gates towards the first position to form a first media path;

c. an actuator that contacts the second gate to position the second gate and indirectly the first gate towards the second position to form a second media path; and d. a second actuator that contacts the first gate and moves the first gate from the first position to the second position independently of the second gate.

11. The diverter of claim 10, wherein one of the media paths leads to a duplexer within an image forming apparatus.

12. The apparatus of claim 10, wherein one of the media paths leads to a finisher within an image forming apparatus.

13. The apparatus of claim 10, wherein one of the media paths leads to an exit from an image forming apparatus.

14. The apparatus of claim 10, wherein the first and second gates are connected to a frame within an image forming apparatus.

15. The apparatus of claim 10, wherein the first and second gates are connected to a fuser frame within an image forming apparatus.

16. A method of diverting media along a media path of an image forming apparatus comprising the steps of:

a. directing the media along a first media path by positioning a pair of gates in a first orientation;

b. directing the media along a second media path by moving the second gate from the first orientation to a second orientation, the first and second gates being positioned in an overlapping arrangement with movement of the second gate from the first orientation to the second orientation causing the first gate to move from the first orientation to the second orientation;

c. directing the media along a third media path by moving the first gate to a second orientation with the second gate in the first orientation; and d. biasing the first and second gates towards the first orientation.

17. The method of claim 16, wherein the step of moving the second gate from the first orientation to the second orientation comprising rotating a cam extending from the second gate.

18. The method of claim 16, wherein the second gate contacts the first gate along the length of the first and second gates.

* * * * *